United States Patent [19]

Dean et al.

[11] Patent Number: 4,587,602

[45] Date of Patent: May 6, 1986

[54] LIGHTING FIXTURE HINGE ASSEMBLY

[75] Inventors: John R. Dean; Edward B. Bilson, both of Memphis, Tenn.

[73] Assignee: FL Industries, Inc., Livingston, N.J.

[21] Appl. No.: 722,503

[22] Filed: Apr. 12, 1985

[51] Int. Cl.[4] ..... F21V 21/26; F21V 21/00

[52] U.S. Cl. ..... 362/375; 362/269

[58] Field of Search ..... 362/269, 319, 322, 375, 362/263; 16/221

[56] References Cited

U.S. PATENT DOCUMENTS

| | | | |
|---|---|---|---|
| 13,158 | 10/1910 | Lockwood | 362/269 |
| 2,101,135 | 12/1937 | Finch | 362/375 |
| 3,991,905 | 11/1976 | Nicpon | 362/375 |
| 4,413,312 | 11/1983 | Morkosky | 362/269 |

*Primary Examiner*—Ronald H. Lazarus

*Attorney, Agent, or Firm*—Laff, Whitesel, Conte & Saret

[57] ABSTRACT

A hinge assembly is provided for a lighting fixture whereby a bezel door is hinged to the fixture housing in a manner that it can be swung open from the open face of the housing but cannot be dropped or lose supported contact with the housing. The hinge assembly is located along one edge of the housing. The hinge assembly comprises a hinge hook portion typically an extension of the lower bezel door edge. The hinge hook is an open-faced, open-ended cylindrical structure having a centerpiece with a stud extending therefrom. The hinge bar comprises two axially aligned cylindrical sections extending typically from the lower edge of the housing. The hinge hook is fitted over the hinge bar sections and a fastener is placed over the hinge hook stud.

11 Claims, 7 Drawing Figures

LIGHTING FIXTURE HINGE ASSEMBLY

BACKGROUND OF THE INVENTION

The present invention relates to a lighting fixture and, more particularly, to a hinge assembly for holding a bezel door to a fixture housing.

A typical outdoor lighting fixture or luminaire for a floodlight or similar application comprises a cast aluminum housing having an open front face. A bezel door is usually hinged to the housing to close against the open housing face. The bezel door has a refractor lens mounted therein. The lamp, usually a high-voltage mercury vapor or high-pressure sodium lamp, is held in a base which, along with the ballast and other necessary electrical components, are mounted in the housing.

It is desirable to hinge mount the bezel door to the housing because for routine maintenance, the most typical being lamp replacement, it greatly simplifies the process if the electrical components of the housing are readily accessible. The bezel door is usually square or rectangular in shape, and a latch mechanism is used to join one edge of the bezel door to an adjacent edge at the front face of the housing. The opposite edges of the bezel door and housing usually contain a hinge assembly. The hinge assembly must be positive in its retention of the bezel door to the housing when the bezel door is swung open. This assures that the bezel door will not be dropped upon opening along the hinge which would almost certainly cause the refractor lens to be broken. Further, a low cost and study hinge is also desired due to the outdoor service to which the fixture will be exposed.

It is also desirable that the hinge is able to be cast in one operation as an integral part of the bezel door and the housing. This assures added strength for the hinge and eliminates assembly steps which would be required if the hinge had to be separately secured to the bezel door and housing.

It is an object of the present invention to provide a lighting fixture having an improved bezel door-housing hinge.

SUMMARY OF THE INVENTION

The present invention provides an improved hinge assembly for use in a lighting fixture. The lighting fixture comprises a housing and a bezel door assembly. The housing is usually a one-piece aluminum casting and usually has a rectangular or square cross-section with a closed back and an open front face. The bezel door assembly is adapted to sealingly close the open front face of the housing and, accordingly, has a rectangular or square shape conforming to that of housing cross-section. The bezel door assembly is usually a one piece aluminum casting forming a frame in which a refractor lens is mounted.

The bezel door is latched along one edge to the housing. This latch can be of any configuration that provides a positive locking of the bezel door against the housing open face, yet which can be readily unlatched for maintaining of the electrical lamp components or for replacement of the refractor lens. A hinge assembly is provided along the edge between bezel door and the housing opposite the latch containing edge. The hinge assembly must permit the ready rotation of the bezel door away from the facing and yet be of sturdy construction and must insure that the bezel door is not permitted to separate from the housing.

The hinge assembly of the present invention includes a hinge bar and a hinge hook. The hinge bar is usually an integral part of and extends from the bottom edge of the housing, and the hinge hook is usually an integral part of and extends from the bottom edge of the bezel door. Of course, in certain applications it may be desirable to have the hinge bar on the bezel door and the hinge hook on the housing.

The hinge bar comprises two cylindrical bar sections that extend from the lower edge of the housing. The cylindrical bar sections are axially aligned along an axis parallel to the lower edge of the housing. Each bar section usually is an integral part of the housing casting. The bar sections are separated, forming a space therebetween.

The hinge hook comprises an elongated concave or generally cylindrical piece having an open front face and extending from the lower edge of the bezel door assembly. The hinge hook includes a centerpiece or block extending from the lower edge to the upper edge of the concave opening, thereby separating the hinge hook into two open-ended, open-front faced chambers. A stud extends from the centerpiece. The length of the hinge hook is selected such that it can be placed around each of the hinge bar sections with each hinge bar section extending into a chamber of the hinge hook, yet such that neither hinge bar section would contact the centerpiece. The hinge hook is usually an integral part of the bezel door casting.

A fastener is placed over the stud to assure that the hinge hook remains secured to the hinge bar, thereby assuring that the bezel door is secured to and cannot fall from the housing. The fastener usually comprises an elongated, generally rectangular, generally flat metal piece of an alloy or spring steel. An opening is generally centrally located in the fastener and is adapted to receive the stud therein. The sides of the fastener opening usually include gripping means such as prongs that will partially embed in the stud to insure the affixing of the fastener to the study. The fastener is of a selected length such that a desired portion of the open face of the hinge hook is covered by the fastener. Accordingly, the hinge bar section will not be able to exit from the hinge hook through the open faces, and the hinge hook will be secured to the hinge bar.

Further, the spacing between the hinge bar section and the length of the hinge hook are selected such that, if the bezel door slides along the hinge axis, the hinge bar sections will remain in their respective hinge hook chambers. One hinge bar section at its connection to the housing will contact an end of the hinge hook chamber before the other hinge bar section exits the other hinge hook chamber.

BRIEF DESCRIPTION OF THE HOUSINGS

DESCRIPTION OF THE PREFERRED EMBODIMENT

Figure 1:
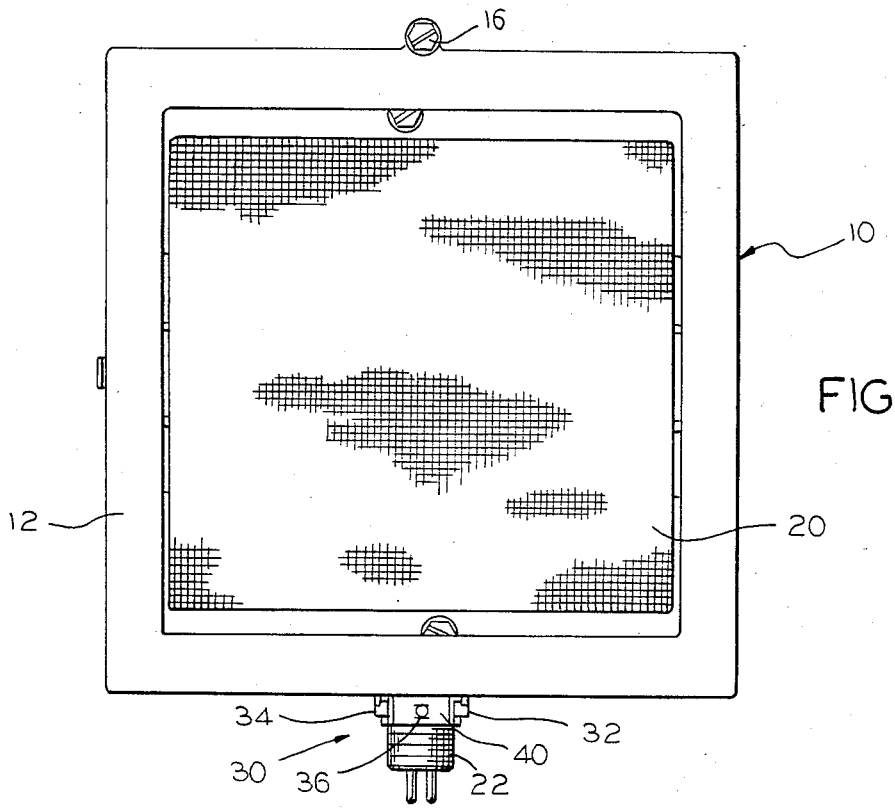
FIG. 1 is a front view of a lighting fixture utilizing the hinge assembly of the present invention.
Figure 2:
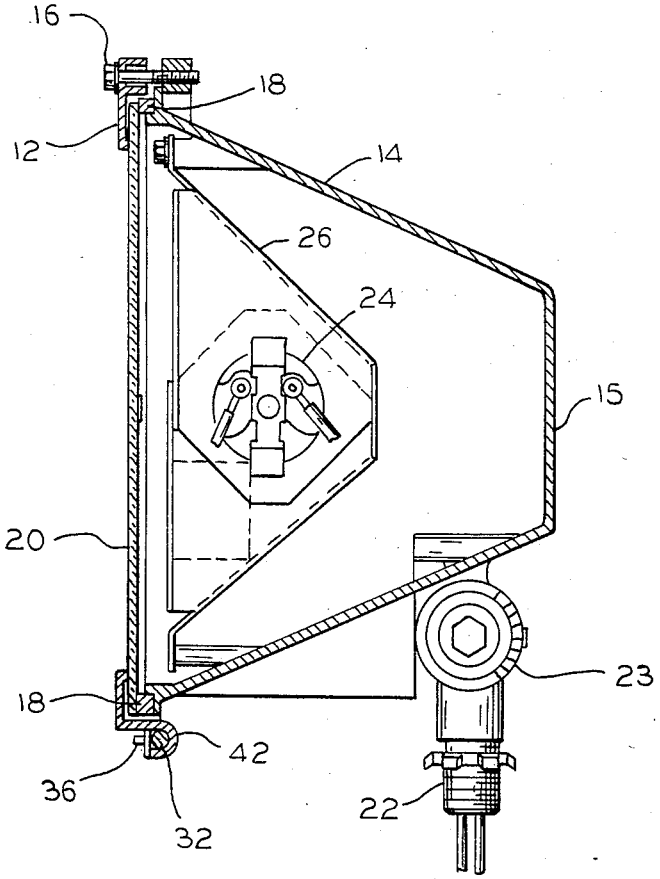
FIG. 2 is a side, partial cross-sectional view of a lighting fixture utilizing the hinge assembly of the present invention.

Referring to FIGS. 1 and 2 of the drawings, a lighting fixture in accordance with the present invention is shown generally at 10. A generally rectangular bezel door 12 is mounted to the open front face of fixture housing 14. Fixture housing 14 is a box-like structure having tapering top, bottom and side walls joined to a rear wall 15. A conduit 22 supplies electrical wires to fixture 10 and enters a fixture support 23 which supports the fixture and permits the angular adjustment of the fixture.

Bezel door 12 includes lens 20 and is sealed against housing 14 by gasket 18 when bezel door 12 is closed against housing 14. Housing 14 includes electrical components for the fixture such as lamp socket 24 and components for desired light transmission such as reflector 26. Bezel door 12 is held against housing 14 along the top edges thereof by a bolt 16 which is threaded into aligned threaded openings in bezel door 12 and housing 14. Upon the unthreading of bolt 16, bezel door 12 can be swung away from housing 14 along the axis of hinge assembly 30 located parallel to the bottom edges of bezel door 12 and housing 14.

Figure 3:
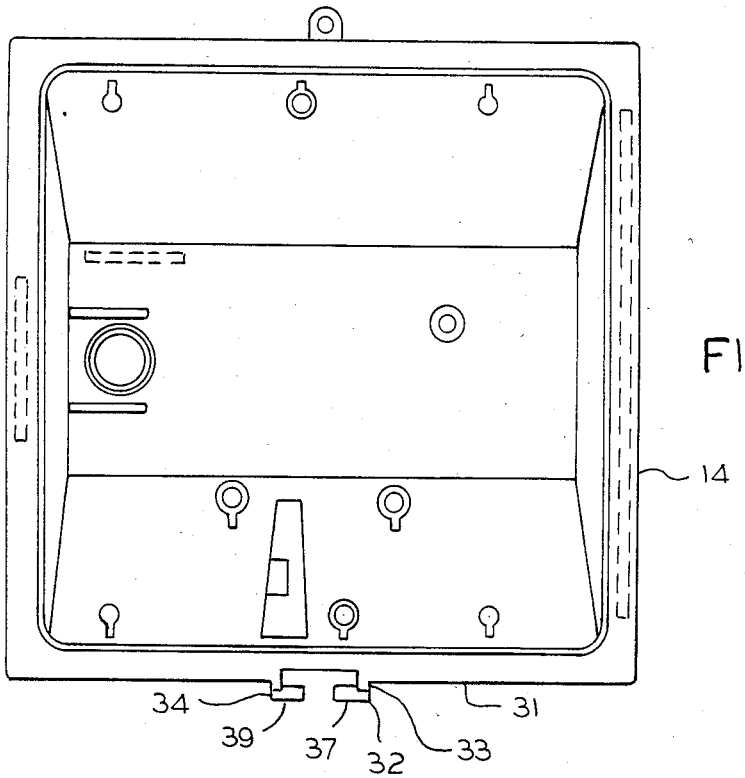
FIG. 3 is a front view of a lighting fixture housing having a hinge bar in accordance with the present invention.
Figure 4:
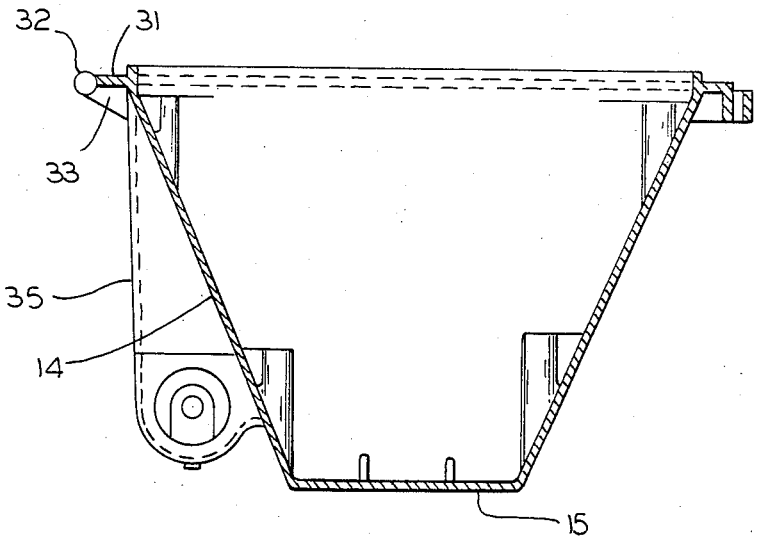
FIG. 4 is a side, partial cross-sectional view of a lighting fixture housing having a hinge bar in accordance with the present invention.
Figure 7:
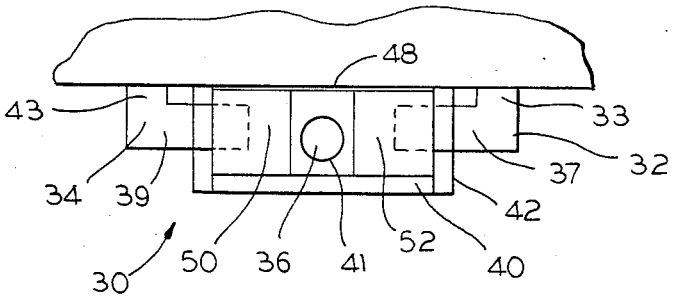
FIG. 7 is a detailed, partial, perspective view of a hinge assembly in accordance with the present invention.

Hinge assembly 30 comprises hinge bars 32 and 34 and hinge hook 42. Referring now also to FIGS. 3, 4 and 7, housing 14 is seen as a single piece aluminum casting of a general box shape having a square front open face and top, bottom and side walls tapering to rear wall 15. Hinge bars 32 and 34 are integral extensions from lower edge 31 of housing 14. Each of hinge bars 32, 34 comprises one support section 33, 43, respectively, extending from housing bottom wall 35 and a cylindrical bar portion 37, 39. Bar portions 37, 39 are spaced apart to form an opening therebetween and are axially striped along an axis parallel to lower edge 31.

Figure 5:
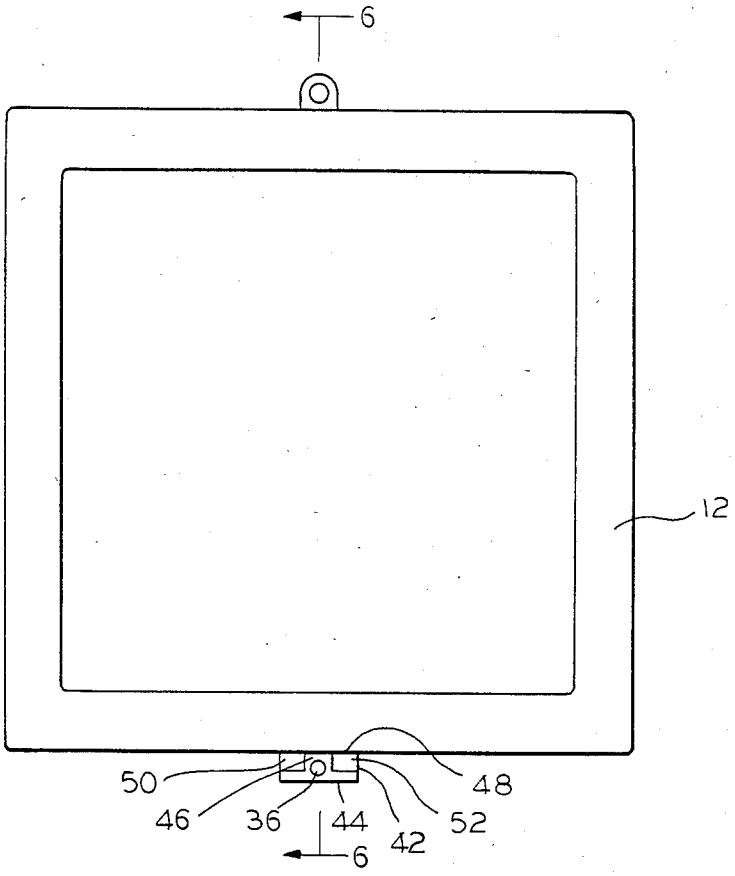
FIG. 5 is a front view of a lighting fixture bezel door having a hinge hook in accordance with the present invention.
Figure 6:
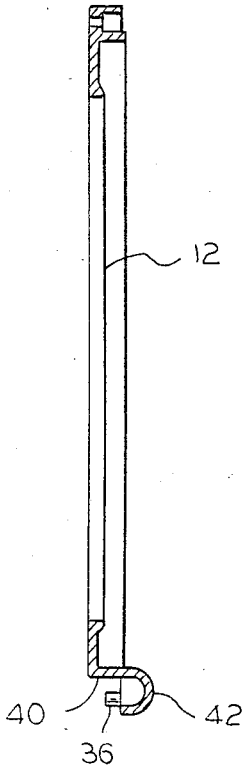
FIG. 6 is a side, partial cross-sectional view of a lighting fixture bezel door having a hinge hook in accordance with the present invention.

Referring now to FIGS. 5, 6 and 7, bezel door 12 is seen to be a generally square cast assembly having top, bottom and side sections framing a central opening adapted to receive a refractor lens. Extending from bottom edge 48 is a protrusion forming hinge hook 42 which is an integral portion of bezel door 12. Hinge hook 42 is a concave, generally cylindrical structure having an open front face and open ends. Lower edge 44 of hinge hook 42 extends the length of hinge hook 42. Centerpiece 46 extends from lower edge 44 to bottom edge 48 of bezel door 12. Centerpiece 46 includes a protruding stud 36 facing outward from the front open face of hinge hook 42. In effect, centerpiece 46 divides hinge hook 42 into two open-ended, open-faced chambers 50 and 52.

A fastener 40 is of a generally rectangular, plate shape and includes a centrally located opening 41. Fastener 40 has a height about equal to the distance between lower edge 48 of bezel door 12 and lower edge 44 of hinge hook 42. The length of fastener 40 is equal to or slightly less than the length of hinge hook 42, but is always greater than the distance between hinge bars 37, 39. The sides of opening 41 include prongs which embed in stud 36 to securely hold fastener 40 to stud 36. Fastener 40 is of a selected length to cover the open front face of hinge hook 42 to the extent that hinge hook 42, after being placed around hinge bars 37, 37, cannot be removed therefrom. Even if bezel door 12 is moved axially along its bottom edge 48, hinge bar support section 33 or 43 would contact the end of hinge hook 42 before the opposite hinge bar 37 or 39 would be able to exit one of the hinge hook chambers 50 or 52.

What is claimed is:

1. A hinge for use in a lighting fixture, said hinge comprising a hinge bar affixed to a lower edge of a lighting fixture housing, said hinge bar having two cylindrical bar sections axially aligned along an axis parallel to the lower edge of the housing, said bar sections being spaced apart from each other to form a gap therebetween, said hinge also comprising a hinge hook affixed to a lower edge of a lighting fixture bezel door, said hinge hook having an elongated concave configuration, with a centerpiece separating the hinge hook into two open-ended, open-faced chambers, and a stud extending from said centerpiece, said hinge hook adapted to fit over said hinge bar such that each of said bar sections is received in one of said hinge hook chambers whereby said bezel door is rotatable to open from and close against said housing along the axis of said hinge, and a fastener fitted over said stud to secure said hinge hook to said hinge bar to assure the affixation of said bezel door to said housing.

2. The hinge of claim 1 wherein said fastener comprises a generally rectangular, generally flat metal plate having an opening adapted to fit over said stud, and said fastener when fitted over said stud closing a portion of each of the open-faced chambers of the hinge hook to secure said hinge hook to said hinge bar.

3. The hinge of claim 2 wherein said fastener includes gripping means around said opening to insure the secure gripping of said fastener to said stud.

4. The hinge of claim 2 wherein said lighting fixture bezel door, hinge hook, and stud are comprised of an aluminum casting, and said fastener is comprised of an alloy steel.

5. The hinge of claim 3 wherein said fastener gripping means comprise prongs which partially embed in said stud when said fastener is installed.

6. The hinge of claim 1 wherein said hinge bar sections are spaced apart a selected distance, said hinge hook is of a selected length and said fastener is of a selected length to cover a selected portion of the open-faced chambers of the hinge hook such that the hinge bar sections remain in their respective hinge hook chambers upon the sliding movement of the bezel door along the hinge axis to thereby assure the securing of the bezel door to the housing.

7. The hinge of claim 6 wherein, upon the sliding movement of the bezel door along the hinge axis, one hinge bar section at its connection to said housing will contact an end of hinge hook chamber before the other hinge bar section exits the other hinge hook chamber.

8. The hinge of claim 1 wherein said hinge hook extends from the lower edge of the lighting fixture bezel door and comprises an elongated generally cylindrical section having open ends and an open front face with said centerpiece comprising a block extending from a bottom edge of said generally cylindrical section to a top edge of said generally cylindrical section in about the axial center portion of said generally cylindrical section to separate said hinge hook into said two open-ended, open-faced chambers.

9. A lighting fixture comprising a housing having an open face, a bezel door adapted to close against the open face of said housing, and a hinge assembly in joining said bezel door to said housing comprising a hinge bar having two generally cylindrical bar sections, said bar sections being axially aligned and spaced apart from each other, and a hinge hook having an elongated, concave configuration, with a center piece separating the hinge hook into two axially aligned, open ended and open faced chambers, and a stud extending from the center piece, said hinge hook adapted to fit with said hinge bar such that each of said bar sections is received in one of said hinge hook chambers, and a fastener adapted to fit over said stud to secure said hinge hook to said hinge bar and to assure the affixation of said bezel door to said housing.

10. The lighting fixture of claim 9 wherein said hinge bar is an extension of a lower edge of said housing and said hinge hook is an extension of the lower edge of said bezel door.

11. The lighting fixture of claim 9 wherein said fastener comprises an elongated metal piece having an opening adapted to receive said stud and thereby hold said fastener to said stud, the length of said fastener being selected so as to cover a selected amount of said hinge hook open faced chambers to assure that said hinge bar sections do not exit from said chambers while allowing said hinge hook to rotate about said hinge bar.

* * * * *